US009336972B2

(12) United States Patent
Hisada et al.

(10) Patent No.: US 9,336,972 B2
(45) Date of Patent: May 10, 2016

(54) SWITCH DEVICE

(71) Applicant: KABUSHIKI KAISHA TOKAI RIKA DENKI SEISAKUSHO, Aichi (JP)

(72) Inventors: Masahito Hisada, Aichi (JP); Makoto Kobayashi, Aichi (JP); Nobuhiko Kitagawa, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 324 days.

(21) Appl. No.: 14/013,620

(22) Filed: Aug. 29, 2013

(65) Prior Publication Data

US 2014/0069788 A1 Mar. 13, 2014

(30) Foreign Application Priority Data

Sep. 7, 2012 (JP) ..... 2012-197427

(51) Int. Cl.
*H01H 13/64* (2006.01)
*H01H 23/24* (2006.01)

(52) U.S. Cl.
CPC ..... *H01H 23/24* (2013.01); *H01H 2215/008* (2013.01); *H01H 2300/01* (2013.01)

(58) Field of Classification Search
CPC ..... H01H 9/00; H01H 23/24; H01H 13/64
USPC ... 200/1 B, 1 R, 5 R, 17 R, 18, 332, 339, 340
See application file for complete search history.

(56) References Cited

U.S. PATENT DOCUMENTS

| | | | | |
|---|---|---|---|---|
| 5,559,311 | A * | 9/1996 | Gorbatoff | 200/513 |
| 6,750,406 | B2 * | 6/2004 | Komatsu et al. | 200/1 B |
| 6,914,202 | B2 | 7/2005 | Sugimoto et al. | |
| 2004/0188235 | A1 | 9/2004 | Sugimoto et al. | |
| 2007/0023269 | A1 | 2/2007 | Shimizu | |
| 2009/0229961 | A1 | 9/2009 | Larsen et al. | |
| 2011/0031097 | A1 | 2/2011 | Vakily et al. | |

FOREIGN PATENT DOCUMENTS

| | | |
|---|---|---|
| CN | 1909133 | 2/2007 |
| CN | 102017036 | 4/2011 |
| CN | 102576617 | 7/2012 |
| JP | 2004-303427 | 10/2004 |
| JP | 2006-202691 | 8/2006 |
| JP | 3810920 | 8/2006 |

OTHER PUBLICATIONS

U.S. Appl. No. 14/013,571 to Masahito Hisada et al., filed Aug. 29, 2013.
Chinese Office Action dated May 6, 2015.
Japanese Office action having mail date of Aug. 12, 2014.

* cited by examiner

*Primary Examiner* — Amy Cohen Johnson
*Assistant Examiner* — Marina Fishman
(74) *Attorney, Agent, or Firm* — Greenblum & Bernstein, P.L.C.

(57) ABSTRACT

A switch device includes a lever and a pusher. The pusher includes a surface that contacts the lever. When force is applied from the lever to the pusher, an inclined surface of the pusher produces a force that moves the pusher from a one-side pushing position to a two-side pushing position. This allows for a user to apply a smaller force to the lever in order to move the pusher from the one-side pushing position to the two-side pushing position and thereby push two switch units.

6 Claims, 6 Drawing Sheets

SWITCH DEVICE

CROSS-REFERENCE TO RELATED APPLICATIONS

This application is based upon and claims the benefit of priority from prior Japanese Patent Application No. 2012-197427, filed on Sep. 7, 2012, the entire contents of which are incorporated herein by reference.

BACKGROUND OF THE INVENTION

The present invention relates to a switch device.

A switch device that opens and closes a power window of a vehicle is arranged in a passenger compartment of the vehicle (for example, refer to Japanese Laid-Open Patent Publication No. 2006-202691).

As shown in FIG. 10, such a switch device includes, for example, a lever 101, a pusher 103, a manual switch 105, and an automatic switch 106.

The manual switch 105 and the automatic switch 106 are arranged on the same plane separated from each other. The pusher 103 includes a lower left end 103*l* opposing the manual switch 105. Further, the pusher 103 includes a lower right end 103*r* opposing the automatic switch 106.

When a user tilts the lever 101, a pushing portion 101*a* formed in the lever 101 pushes the upper left surface of the pusher 103 with force Fp. Force Fp acts on the upper surface of the pusher 103 in the vertical direction. This slightly tilts the pusher 103 in the counterclockwise direction as viewed in the drawing. As a result, the lower left end 103*l* of the pusher 103 pushes and activates the manual switch 105. When the user further tilts the lever 101, the pushing portion 101*a* applies force Fp to the upper left surface of the pusher 103 and changes the tilting direction of the pusher 103. This slightly tilts the pusher 103 in the opposite clockwise direction as viewed in the drawing. As a result, the lower right end 103*r* of the pusher 103 pushes the automatic switch 106. Thus, the manual switch 105 and the automatic switch 106 are both activated.

In the above switch device, the pushing portion 101*a* applies force Fp to the upper surface of the pusher 103 in the vertical direction to push the pusher 103. Thus, it is difficult for a force that changes the tilting direction of the pusher 103, that is, a force for activating the automatic switch 106, to be applied to the pusher 103. This results in the user applying a strong force to the lever 101.

SUMMARY OF THE INVENTION

One aspect of the present invention is a switch device including a substrate, a first switch unit and a second switch unit separated from each other and arranged on the substrate, and a pusher that is movable to any one of an initial position where the pusher does not any push one of the first and second switch units, a one-side pushing position where the pusher pushes only the first switch unit, and a two-side pushing position where the pusher pushes both of the first and second switch units. A lever comes into contact with the pusher when tilted by a user and moves the pusher from the initial position to the one-side pushing position. When the pusher is located at the one-side pushing position and the lever is further tilted by the user, the lever moves the pusher from the one-side pushing position to the two-side pushing position. The pusher includes a contact surface that comes into contact with the lever. The contact surface is shaped so that force applied from the lever to the pusher produces a force that moves the pusher from the one-side pushing position to the two-side pushing position.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

One embodiment of a switch device will now be described in detail with reference to FIGS. 1 to 8. In the present embodiment, the switch device is a switch for a vehicle power window.

Figure 1:
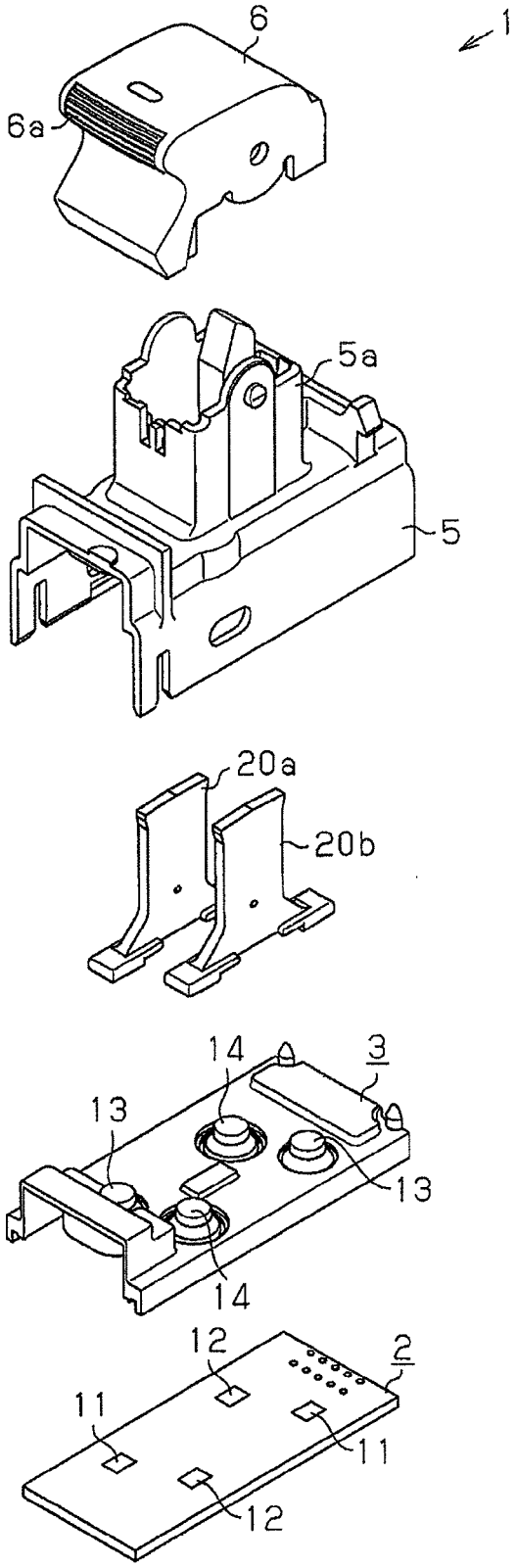
FIG. 1 is an exploded perspective view of a switch device according to one embodiment of the present invention.

Referring to FIG. 1, the switch device 1 includes a contact substrate 2, a base 3, two pushers 20*a* and 20*b*, a switch body 5, and a lever 6.

The contact substrate 2 is a printed circuit board (PCB) formed from glass epoxy resin or the like. Two manual fixed contacts 11 and two automatic fixed contacts 12 are arranged on the contact substrate 2.

The base 3 is formed from a resiliently deformable soft resin such as silicon rubber. The base 3 is arranged on the contact substrate 2. The base 3 includes two manual contact domes 13, respectively opposed to the two manual fixed contacts 11, and two automatic contact domes 14, respectively opposed to the two automatic fixed contacts 12.

Figure 2:
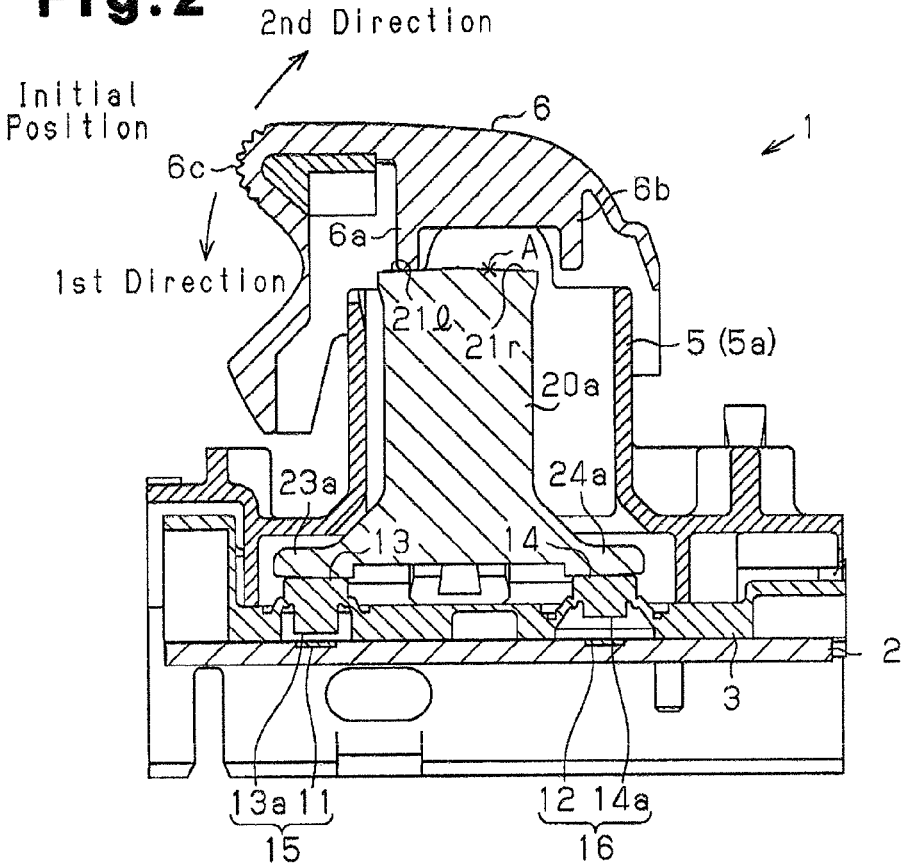
FIG. 2 is a cross-sectional view of the switch device when a pusher is in an initial position.

Referring to FIG. 2, each of the domes 13 and 14 is convex and includes an upper portion that is resiliently deformed when pushed. A conductive manual movable contact 13*a* is formed in each manual contact dome 13, and a conductive automatic movable contact 14*a* is formed in each automatic contact dome 14. When the manual and automatic contact domes 13 and 14 are not resiliently deformed, the movable contacts 13*a* and 14*a* are separated from the corresponding fixed contacts 11 and 12. When the manual and automatic contact domes 13 and 14 are resiliently deformed, the movable contacts 13*a* and 14*a* contact the corresponding fixed contacts 11 and 12.

The manual fixed contacts 11 and the manual movable contacts 13*a* form a manual switch unit 15. When a manual fixed contact 11 comes into contact with the corresponding manual movable contact 13*a* and is supplied with power, the manual switch unit 15 is activated. Further, the automatic fixed contacts 12 and the automatic movable contacts 14*a* form an automatic switch unit 16. When an automatic fixed contact 12 comes into contact with the automatic movable contact 14*a* and is supplied with power, the automatic switch unit 16 is activated. The two pushers 20*a* and 20*b* are each arranged on the manual switch unit 15 and the automatic switch unit 16.

As shown in FIG. 1, the two pushers 20*a* and 20*b* and the switch body 5 are arranged above the base 3. The switch body 5 is fixed to the contact substrate 2 and the base 3.

The switch body 5 includes a main portion and a hollow holding portion 5*a*, which includes a hole extending from the main portion. The two pushers 20*a* and 20*b* are arranged in the holding portion 5*a* and supported in a tiltable manner. The lever 6 is fitted to an upper section of the holding portion 5*a* and is tiltable relative to the switch body 5. Referring to FIG. 2, the lever 6 is tilted about axis A.

As viewed in FIG. 2, the lever 6 is tiltable in a first direction in which an operation portion 6*c* of the lever 6 moves toward the manual contact dome 13 and a second direction in which the operation portion 6*c* moves away from the manual contact dome 13. When closing the vehicle window, the lever 6 is tilted in the first direction. When opening the vehicle window, the lever 6 is pivoted in the second direction.

Two pushing portions 6*a* and 6*b* that project toward the base 3 are arranged in the lever 6. The pushing portions 6*a* and 6*b* each have a lower end that is allowed to come into contact with the upper surfaces of the two pushers 20*a* and 20*b*.

Referring to FIG. 2, the pusher 20*a* is a plate formed from resin and includes a lower left end 23*a* and a lower right end 24*a*. The lower left end 23*a* is located in correspondence with one of the manual contact domes 13. The lower right end 24*a* is located in correspondence with one of the automatic contact domes 14.

Figure 7:
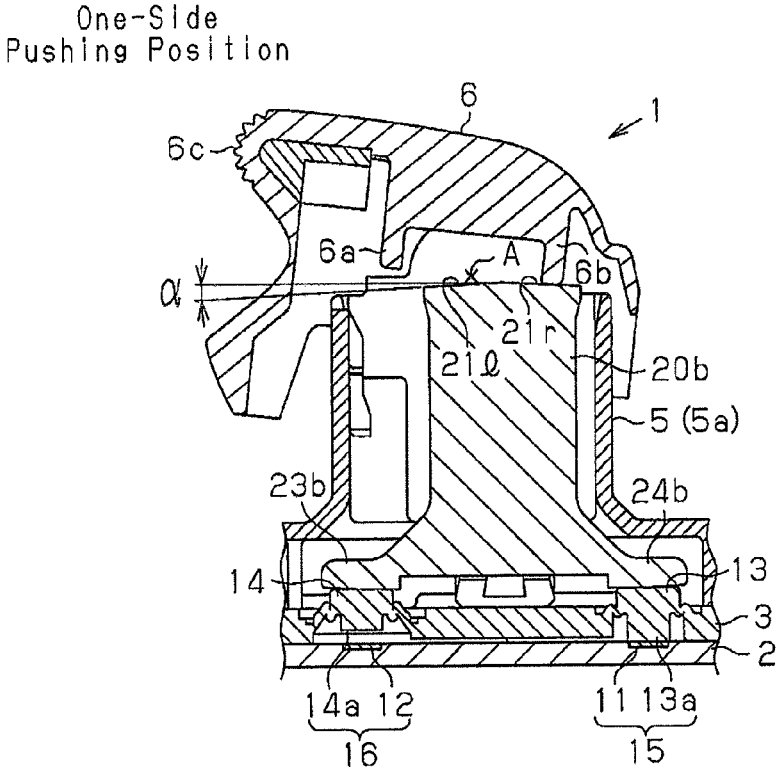
FIG. 7 is a cross-sectional view of the switch device when another pusher is in a one-side pushing position.

Referring to FIG. 7, the pusher 20*b* is a plate formed from resin and includes a lower left end 23*b* and a lower right end 24*b*. The lower left end 23*a* is located in correspondence with one of the automatic contact domes 14. The lower right end 24*b* is located in correspondence with one of the manual contact domes 13.

Figure 6:
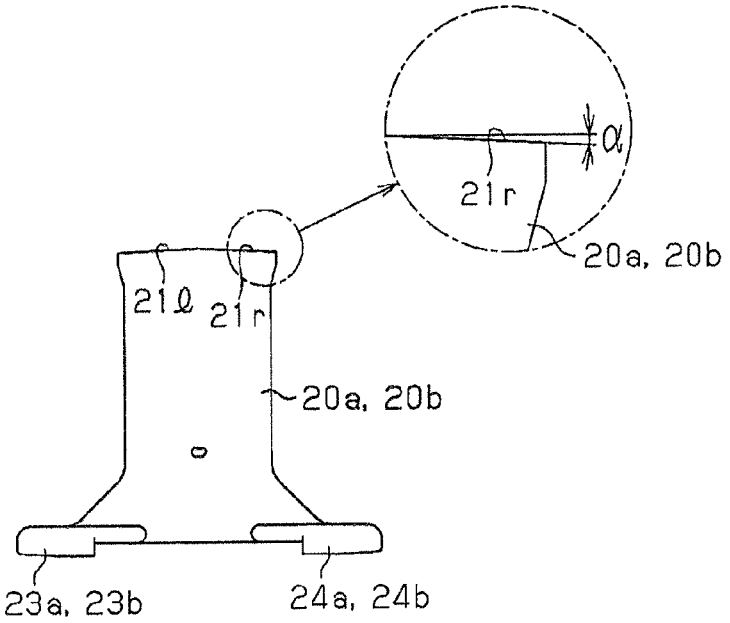
FIG. 6 is a front view of the pusher.

Referring to FIG. 6, the upper surface of each of the pushers 20*a* and 20*b* includes two inclined surfaces 21*l* and 21*r*. In each of the pushers 20*a* and 20*b*, the inclined surface 21*l* is inclined from the middle of the upper surface toward the left end, and the inclined surface 21*r* is inclined from the middle of the upper surface toward the right end. More specifically, the upper surface of each of the pushers 20*a* and 20*b* is downwardly inclined from the middle to the left and right ends. In other words, in the upper surface of the pusher 20*a*, the inclined surface 21*l* is inclined toward the manual switch unit 15 relative to a hypothetical level plane on the upper surface, and the inclined surface 21*r* is inclined toward the automatic switch unit 16 relative to the hypothetical level plane. In the upper surface of the pusher 20*b*, the inclined surface 21*l* is inclined toward the automatic switch unit 16 relative to a hypothetical level plane on the upper surface, and the inclined surface 21*r* is inclined toward the manual switch unit 15 relative to the hypothetical level plane. The pushers 20*a* and 20*b* are each symmetric in the widthwise direction (lateral direction of the drawing). The inclination angle $\alpha$ of the two inclined surfaces is, for example, 2° to 5°.

Figure 3:
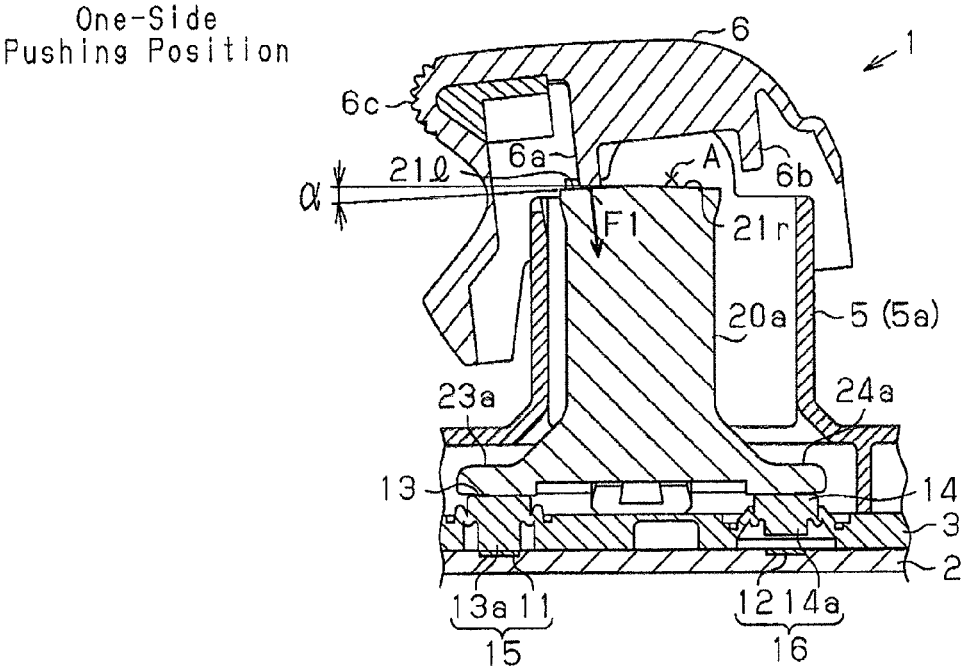
FIG. 3 is a cross-sectional view of the switch device when the pusher is in a one-side pushing position.
Figure 4:
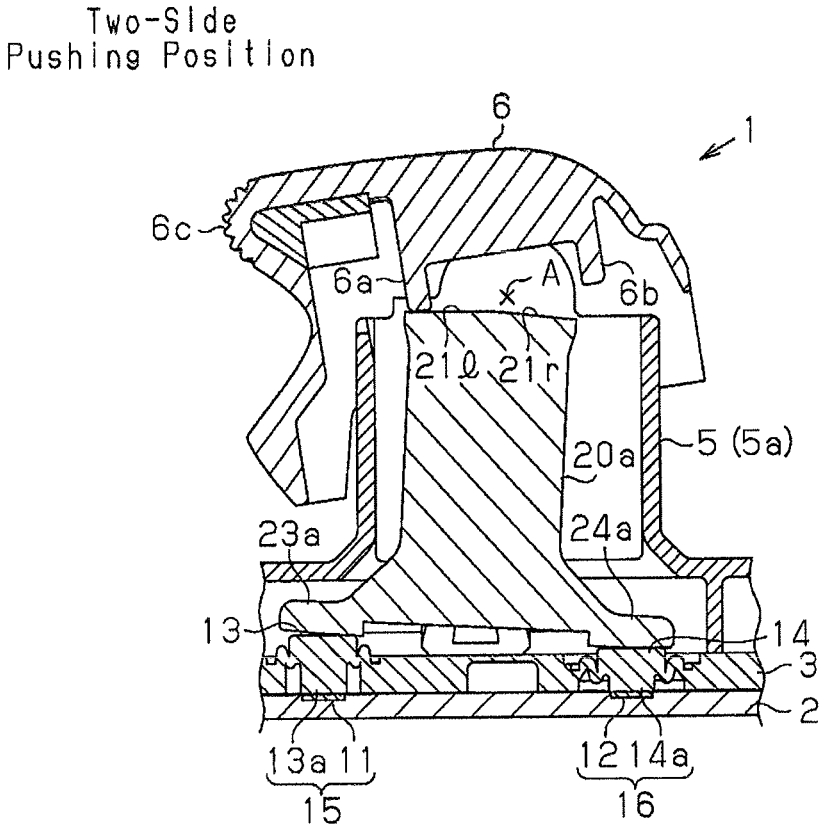
FIG. 4 is a cross-sectional view of the switch device when the pusher is in a two-side pushing position.
Figure 5:
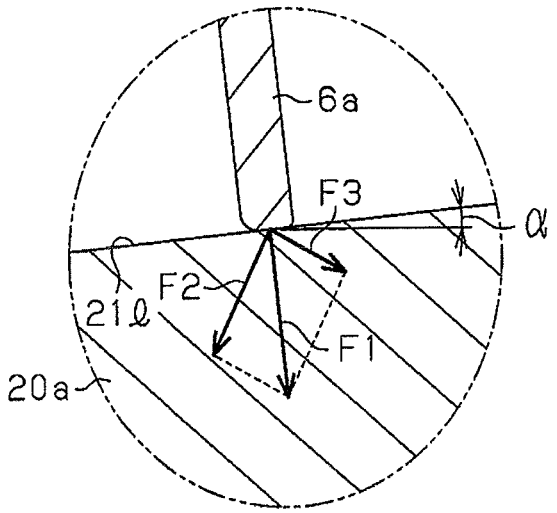
FIG. 5 is a diagram illustrating the force received by the pusher.

Referring to FIGS. 2 to 4, the pusher 20*a* may be moved to an initial position, a one-side pushing position, and a two-side pushing position.

As shown in FIG. 2, when the pusher 20*a* is arranged at the initial pushing position, the two ends 23*a* and 24*a* of the pusher 20*a* are located at the same height. In this case, the two ends 23*a* and 24*a* do not push the corresponding manual and automatic contact domes 13 and 14.

As shown in FIG. 3, when the pusher 20*a* is arranged at the one-side pushing position, the left end 23*a* is slightly lower than the right end 24*a*. In this case, the left end 23*a* pushes the corresponding manual contact dome 13.

As shown in FIG. 4, when the pusher 20*a* is arranged at the two-side pushing position, the right end 24*a* is lower than the left end 23*a*. In this case, the two ends 23*a* and 24*a* respectively push the corresponding manual and automatic contact domes 13 and 14.

In the same manner, the pusher 20*b* may also be moved to an initial position, a one-side pushing position, and a two-side pushing position. Referring to FIG. 7, the manual and automatic contact domes 13 and 14 of the pusher 20*b* are located at positions that are opposite from the pusher 20*a*. Thus, when the pusher 20*b* is located at the one-side pushing position, the pusher 20*b* is inclined in a direction opposite to the direction in which the pusher 20*a* is inclined when the pusher is located at the one-side pushing position.

An urging means returns the lever 6 from the one-side pushing position or the two-side pushing position to the initial position shown in FIG. 2. When the lever 6 is arranged at the initial position, the two pushing portions 6*a* and 6*b* do not push the two pushers 20*a* and 20*b*.

The operation of the switch device 1 will now be described with reference to FIGS. 2 to 4.

When the pusher 20*a* is arranged at the initial position shown in FIG. 2, the user may tilt the lever 6 in the first direction. As a result, the pushing portion 6*a* of the lever 6 pushes the left inclined surface 21*a* of the pusher 20*a*, which is at the initial position.

Referring to FIG. 3, the pushing portion 6*a* of the lever 6 applies a force F1 to the pusher 20*a* that is greater than or equal to a certain value. This moves the pusher 20*a* from the initial position to the one-side pushing position. As the pusher 20*a* tilts, the pushing portion 6*a* slides along the inclined surface 21*l* and activates the manual switch unit 15.

When the pusher 20*a* is located at the one-side pushing position, the user may further tilt the lever 6 in the first direction. In such a case, referring to FIG. 5, the pusher 20*a* applies force F1 in a direction orthogonal to the inclined surface 21*l*. The force F1 is split into force F2, which mainly acts on the manual contact dome 13 through the left end 23*a*, and force F3, which mainly acts on the automatic contact dome 14 through the lower right end 24*a*. Force F3 moves the pusher 20*a* from the one-side pushing position to the two-side pushing position. The force F3 increases in accordance with the inclination angle $\alpha$ of the inclined surface 21*l*.

Referring to FIG. 4, when the pusher 20*a* receives force F3 that is greater than or equal to a certain value, the pusher 20*a* moves from the one-side pushing position to the two-side pushing position. As the pusher 20*a* tilts, the pushing portion 6*a* slides along the inclined surface 21*l*. This activates both of the switch units 15 and 16.

As shown in FIG. 7, when the user tilts the lever 6 in the second direction, the pushing portion 6*b* pushes the inclined surface 21*r* of the pusher 20*b*. In the same manner as described above, this moves the pusher 20*b* from the initial position to the one-side pushing position, and then from the one-side pushing position to the two-side pushing position. In this case, the inclined surface 21*r* is inclined at inclination angle α. This increases the force that moves the pusher 20*b* from the one-side pushing position to the two-side pushing position.

Figure 8:
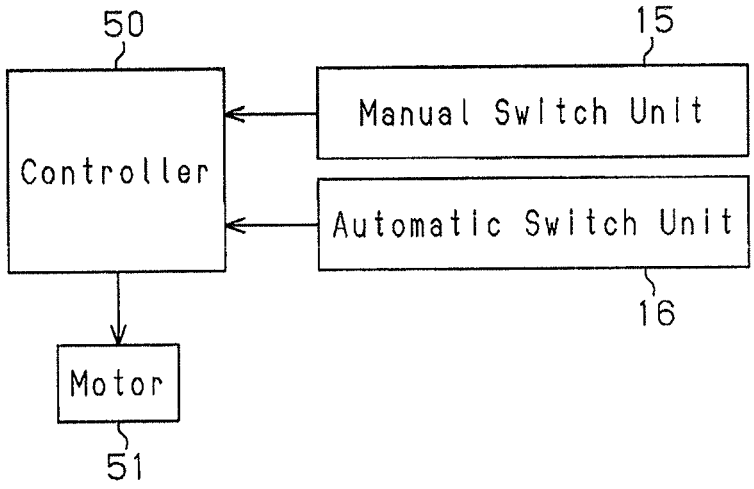
FIG. 8 is a block diagram showing the structure of the switch device.

Referring to FIG. 8, a power window device includes a controller 50, the manual switch unit 15, the automatic switch unit 16, and a motor 51. When the lever 6 is tilted in the first direction and only the manual switch unit 15 is activated, the controller 50 drives the motor 51 and opens the vehicle window. When the manual switch unit 15 and the automatic switch unit 16 are both activated, the controller 50 drives the motor 51 and fully opens the vehicle window. Tilting of the lever 6 in the second direction activates the two switch units 15 and 16 corresponding to the pusher 20*b* that differ from the two switch units 15 and 16 corresponding to the pusher 20*b*. In this case, the controller 50 closes the vehicle window in accordance with the activation of the two switch units 15 and 16 corresponding to the pusher 20*b*.

The above embodiment has the advantages described below.

(1) Each of the pushers 20*a* and 20*b* include the two inclined surfaces 21*l* and 21*r* that split the force received from the lever 6 when contacting the lever 6 into forces that move the pushers 20*a* and 20*b* to the one-side pushing position and the two-side pushing position. This allows for the user to move the two pushers 20*a* and 20*b* to the two pushing positions and thereby push the two switch units 15 and 16 with a smaller force. This improves the operability of the switch device 1.

(2) Each of the pushers 20*a* and 20*b* include the two inclined surfaces 21*l* and 21*r*. When the inclined surfaces 21*l* and 21*r* are in contact with the lever 6, the inclination angle α of the inclined surfaces 21*l* and 21*r* increases the force that moves the pushers 20*a* and 20*b* from the one-side pushing position to the two-side pushing position. Thus, the inclination angle α of the inclined surfaces 21*l* and 21*r* easily adjusts the force applied to the two pushers 20*a* and 20*b* and allows for the two pushers 20*a* and 20*b* to be easily moved from the one-side pushing position to the two-side pushing position.

Further, the two inclined surfaces 21*l* and 21*r* are easily formed, and the inclination angle α of the two inclined surfaces 21*l* and 21*r* is easy to measure. This allows for easy determination of whether or not the two inclined surfaces 21*l* and 21*r* are formed.

(3) Each of the pushers 20*a* and 20*b* is symmetric relative to the axis A of the lever 6. That is, in each of the pushers 20*a* and 20*b*, the two inclined surfaces 21*l* and 21*r* are formed on opposite sides of the axis A of the lever 6. Thus, the coupling direction of the two pushers 20*a* and 20*b* is not limited in the switch device 1. This improves the assembling characteristics of the switch device 1. Further, the two pushers 20*a* and 20*b* may have identical structures.

(4) By setting each of the inclined surfaces 21*l* and 21*r* with an inclination angle of 2° to 5°, the pushers 20*a* and 20*b* may be moved from the one-side pushing position to the two-side pushing position with an appropriate force. The appropriate force is larger than that applied to move the pushers 20*a* and 20*b* from the initial position to the one-side pushing position and smaller than a level that would be a burden to the user. This provides the user with a tactile feel when activating and deactivating the switch units 15 and 16.

(5) In the prior art, the pushers 20*a* and 20*b* have level upper surfaces. Thus, when the two pushing portions 6*a* and 6*b* apply force F1 to the pushers 20*a* and 20*b*, a small force F3 moves the pushers 20*a* and 20*b* from the one-side pushing position to the two-side pushing position. Thus, to move the pushers 20*a* and 20*b* from the one-side pushing position to the two side-pushing position, a greater force Fl would have to be applied to the pushers 20*a* and 20*b*. In contrast, the present embodiment increases force F3. This allows for a decrease in the force Fl applied to the pushers 20*a* and 20*b*. Thus, wear is suppressed in the pushers 20*a* and 20*b* that would be caused by the pushing force from the two pushing portions 6*a* and 6*b*. This prolongs the life of the switch device 1.

It should be apparent to those skilled in the art that the present invention may be embodied in many other specific forms without departing from the spirit or scope of the invention. Particularly, it should be understood that the present invention may be embodied in the following forms.

In the above embodiment, each of the pushers 20*a* and 20*b* is symmetric in the widthwise direction, and the upper surface of each of the pushers 20*a* and 20*b* includes the two inclined surfaces 21*l* and 21*r*. Instead, one of the inclined surfaces 21*l* and 21*r* may be a level surface.

In the above embodiment, the upper surface of each of the pushers 20*a* and 20*b* does not necessarily have to include the two inclined surfaces 21*l* and 21*r*.

Figure 9:
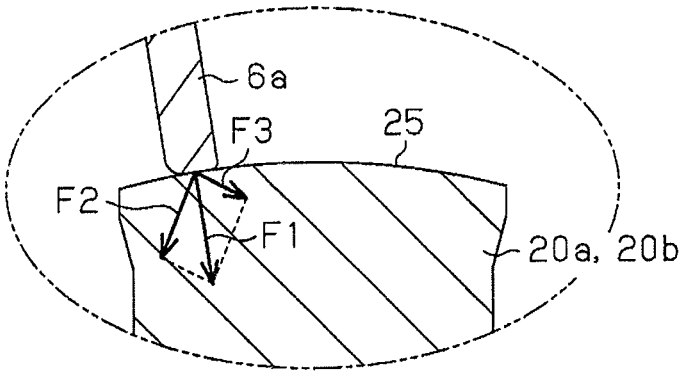
FIG. 9 is a cross-sectional view showing the structure of a switch device according to a further embodiment of the present invention.
Figure 10:
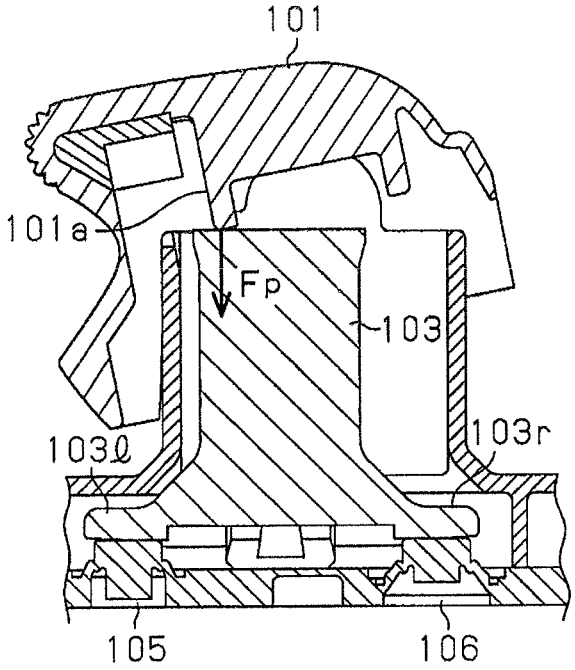
Fig.10(Prior Art)
FIG. 10 is a cross-sectional view showing a switch device of the prior art.

For example, as shown in FIG. 9, the upper surface of each of the pushers 20*a* and 20*b* may be a curved surface 25. In the same manner as the two inclined surfaces 21*l* and 21*r*, the curved surface 25 is curved so as to descend from the middle toward the left and right ends. In other words, the upper surface of each of the pushers 20*a* and 20*b* include an inclined surface 21*l*, which is curved toward the manual switch unit 15 from a hypothetical level plane on the upper surface, and an inclined surface 21*r*, which is curved toward the automatic switch unit 16 from the hypothetical level plane. The curved surface 25 is designed so that the force from the pushing portion 6*a* increases force F3, which moves the pusher 20*a* or 20*b*. A smaller radius of curvature of the curved surface 25 results in a larger force F3. The shape of the curved surface 25 reduces frictional resistance between the curved surface 25 and the pushing portion 6*a* when the pushers 20*a* and 20*b* are tilted. This allows for a decrease in the force used to operate the lever 6.

In the above embodiment, the switch device 1 is used with a power window but may be used with a different subject.

The present examples and embodiments are to be considered as illustrative and not restrictive, and the invention is not to be limited to the details given herein, but may be modified within the scope and equivalence of the appended claims.

What is claimed is:

1. A switch device comprising:

a substrate;

a first switch unit and a second switch unit separated from each other and arranged on the substrate;

a pusher that is pivotable to any one of an initial position where the pusher does not push any one of the first and second switch units, a one-side pushing position where the pusher pushes only the first switch unit, and a two-side pushing position where the pusher pushes both of the first and second switch units; and a lever that comes into contact with the pusher when tilted and moves the pusher from the initial position to the one-side pushing position, wherein when the pusher is located at the one-side pushing position and the lever is further tilted, the lever moves the pusher from the one-side pushing position to the two-side pushing position, the pusher includes a contact surface that comes into contact with the lever, and the contact surface is downwardly inclined from a middle portion thereof to two ends in a widthwise direction of the pusher so that force applied from the lever to the pusher produces a force that moves the pusher from the one-side pushing position to the two-side pushing position.

2. The switch device according to claim 1, wherein the contact surface includes an inclined surface that is inclined toward the first switch unit relative to a hypothetical level plane on the contact surface, and the inclined surface is inclined at an inclination angle that increases the force moving the pusher from the one-side pushing position to the two-side pushing position relative to the force applied from the lever to the pusher.

3. The switch device according to claim 2, wherein the pusher is symmetric in a direction orthogonal to an axis of the lever.

4. The switch device according to claim 2, wherein the inclination angle is 2° to 5°.

5. The switch device according to claim 1, wherein the contact surface includes a curved surface curved toward the first switch unit relative to a hypothetical level plane on the contact surface, and the curved surface has a radius of curvature that increases the force moving the pusher from the one-side pushing position to the two-side pushing position relative to the force applied from the lever to the pusher.

6. A switch device comprising:

a substrate;

a first switch unit and a second switch unit separated from each other and arranged on the substrate;

a pusher arranged on the substrate and including a lower end configured to push the first and second switch units and an upper end opposite to the lower end, wherein the pusher is pivotable to any one of an initial position where the pusher does not push any one of the first and second switch units, a one-side pushing position where the pusher pushes only the first switch unit, and a two-side pushing position where the pusher pushes both of the first and second switch unit; and a lever arranged on the pusher, wherein the lever pushes the upper end of the pusher when tilted and moves the pusher from the initial position to the one-side pushing position, and when the pusher is located at the one-side pushing position and the lever is further tilted, the lever moves the pusher from the one-side pushing position to the two-side pushing position, the upper end of the pusher includes a contact surface at a location pushed by the lever, and the contact surface is inclined so that a distance from the lever to the pusher increases as a distance from a middle portion of the upper end increases.

* * * * *